US005458319A

United States Patent [19]

Mackay

[11] Patent Number: 5,458,319

[45] Date of Patent: Oct. 17, 1995

[54] RETAINER DEVICE FOR RETAINING SLATS TO A CHAIN LINK FENCE

[76] Inventor: Dana J. Mackay, 24050 Madison St. #100, Torrance, Calif. 90502

[21] Appl. No.: 104,547

[22] Filed: Aug. 11, 1993

[51] Int. Cl.[6] ..... E04H 17/06

[52] U.S. Cl. ..... 256/34; 256/1; 24/289; 248/231.81

[58] Field of Search ..... 256/34, 35, 24, 256/32, 21, 22, 47, 1, 48, 50, 54; 403/397; 24/453, 289; 248/231.8, 231.9

[56] References Cited

U.S. PATENT DOCUMENTS

| | | | |
|---|---|---|---|
| 2,802,645 | 8/1957 | Rice . | |
| 3,069,142 | 12/1962 | Kessler . | |
| 3,285,577 | 11/1966 | Pinson . | |
| 3,345,706 | 10/1967 | Stokes | 403/397 |
| 3,572,640 | 3/1971 | Vecchiarelli . | |
| 3,712,590 | 1/1973 | Tochner et al. . | |
| 3,913,889 | 10/1975 | Nugent et al. . | |
| 4,085,954 | 4/1978 | Thompson . | |
| 4,512,556 | 4/1985 | Meglino . | |
| 4,570,906 | 2/1986 | Walden . | |
| 4,723,761 | 2/1988 | Cluff | 256/34 |
| 4,725,044 | 2/1988 | Cluff . | |
| 4,840,334 | 6/1989 | Kikuchi | 24/453 X |
| 5,007,619 | 4/1991 | Sibeni . | |
| 5,275,381 | 1/1994 | Cluff et al. | 256/35 |

*Primary Examiner*—Eric K. Nicholson
*Assistant Examiner*—Harry C. Kim
*Attorney, Agent, or Firm*—Edward A. Sokolski

[57] ABSTRACT

A flat retainer device has elongated fingers on the left and right sides thereof, said fingers running opposite a side wall of the central portion of the retainer. A slot is formed between each of the fingers and the central portion, the fingers and the main body portion forming a locking hook structure. A protuberance is formed on the lower portion of each side of the central portions opposite each finger, these protuberances closing off most of the opening to the slot on the free end of the fingers. The left and right hand sides of the device are mirror images of each other and have the same structural characteristics. The top and bottom ends of the central portion of the device have indentations formed therein. An elongated groove is formed in the slat, the length of this groove being designed to receive the central portion of the retainer member with the indentations thereof abutting against the end walls of the groove in a force fit relationship. The hook formed by the finger on one side or the other of the slat formed by the fingers can be attached to a selected link of the fence, as the situation may require, thereby holding the slat level and locking it in place.

5 Claims, 1 Drawing Sheet

RETAINER DEVICE FOR RETAINING SLATS TO A CHAIN LINK FENCE

BACKGROUND OF THE INVENTION

1. Field of the Invention

This invention relates to fences and more particularly to a retainer device for retaining slats within a chain link fence.

2. Description of the Related Art

In order to afford both privacy and higher security, slats are often installed in chain link fences. Such slats may be of wood, plastic or metal. When such slats are installed, it is necessary to provide suitable means for securing the slats in position. Such securing means preferably should be of a nature to make removal somewhat difficult to discourage theft. Also, simplicity and speed and economy of installation are to be desired.

Prior art devices for retaining slats in chain link fences take several forms. In certain of such devices, as shown in U.S. Pat. No. 4,085,954 issued Apr. 25, 1978 to Thompson, the slats are retained in position by means of top and/or bottom retainer slats which run laterally across the bottom or top of the fence. In certain of these devices, such as U.S. Pat. No. 4,512,556 issued Apr. 23, 1985 23, 1985 to Meglino, the slats are hollow and the cross retainer slat can be run through an opening formed in the vertical slats. In other prior art devices such as shown in U.S. Pat. No. 4,725,044 issued Feb. 16, 1988 to Cluff, U.S. Pat. No. 3,572,640 issued Mar. 30, 1971 to Vecchiarelli, and U.S. Pat. No. 3,913,889 issued Oct. 21, 1975 to Nugent, et al., staples, or hook members are used to secure the slats to the fence.

All of these prior art devices either involve cumbersome or time consuming installations or are overly expensive in their contruction. The device of the present invention obviates these shortcomings in providing a simple inexpensive retainer device which can be rapidly and easily preinstalled on the slats and the slats then easily and rapidly installed on the fence. A particular advantage of applicant's invention lies in its employment of a pair of similar hook retainer members, one of which is on one side of the slat and the other of which is on the slat's opposite side. This facilitates installation in that a hook retainer member is available to attach the slat to either a portion of fence forward of the slat or to the rear thereof so that the slats can be placed in position without first considering which way the slat must be turned to enable proper attachment to fence link.

SUMMARY OF THE INVENTION

The device of the present invention is substantially flat and has left and right side portions which are mirror images of each other. Each of such side portions has an elongated finger which runs opposite a side wall of the central portion of the device. A slot is formed between the fingers and their associated central portion side wall thereby forming a hook. A protuberance extends towards each finger from the lower end of the opposing side wall of the central portion, these protuberances blocking most of the entry space into the slot. The fingers with the protuberances form locking members which permit the fingers to be readily hooked onto the fence and then retained in place thereon. The top and bottom end walls of the central portion of the retainer device have indentations formed therein. An elongated slot is formed in the slat, the length of this slot being chosen to receive the retainer device therein with the end walls of the slot inserted in the indentations of the retainer in a force fitted manner. The similar hooks of the retainer member extend out from opposite sides of the slat to enable attachment of the slat to a link of the fence either on the front or rear thereof. While the locking members formed by the fingers and protuberances can readily be snapped in place on the fence, once so installed, they are secured to the fence in a manner making their removal difficult.

It is therefore an object of the invention to facilitate the attachment of slats to a chain link fence.

It is a further object of the invention to provide an improved device for retaining a slat to a chain link fence which provides securing hook members on both sides of the slat to enable selective attachment to links on either side of the slat.

Other objects of the invention will become apparent as the description proceeds in connection with the accompanying drawings.

DETAILED DESCRIPTION OF THE INVENTION

Figure 1:
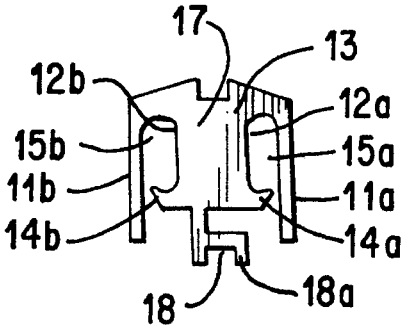
FIG. 1 is a front elevational view of a preferred embodiment of the invention.
Figure 3:
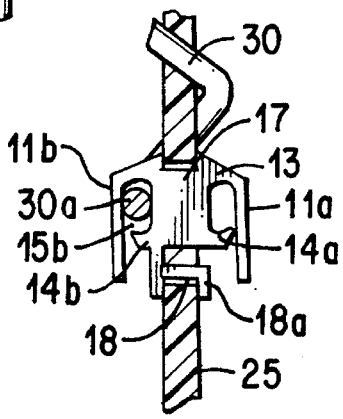
FIG. 3 is a side elevational view illustrating the preferred embodiment being utilized to retain a slat member to a chain link fence.

Referring now to FIG. 1, a preferred embodiment of the invention is shown. The device of the invention is substantially flat and has a central portion 13. Similar fingers 11*a* and 11*b* run along opposite sides of the device opposite side walls 12*a* and 12*b* of the central portion respectively. Protuberances 14*a* and 14*b* extend from the bottom ends of side walls 12*a* and 12*b* respectively towards associated fingers 11*a* and 11*b*. The protuberances block most of the entry space into the slots 15*a* and 15*b* but are curved on their bottom ends to permit ready entry of a chain link into the slots but block removal of the link once it is installed in the slot, as can be seen in FIG. 3. The left and right sides of the device are mirror images of each other.

The top and bottom end walls of the central portion 13 have indented portions 17 and 18 respectively. Indented portion 18 is longer on one side 18*a* than the opposite side thereof.

Figure 2:
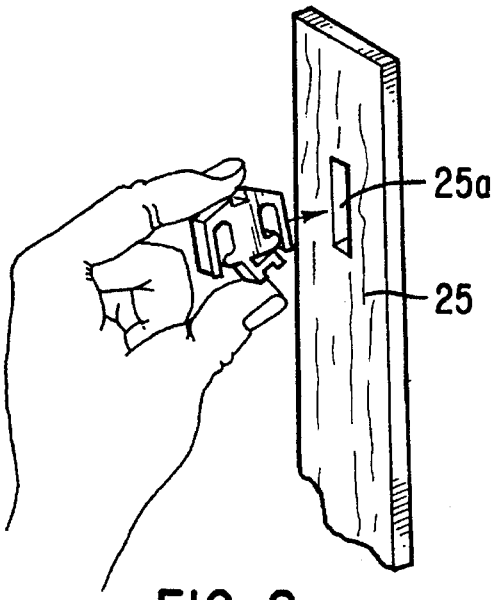
FIG. 2 is a perspective view illustrating the placement of the preferred embodiment in a slat member for installation on a chain link fence.
Figure 5:
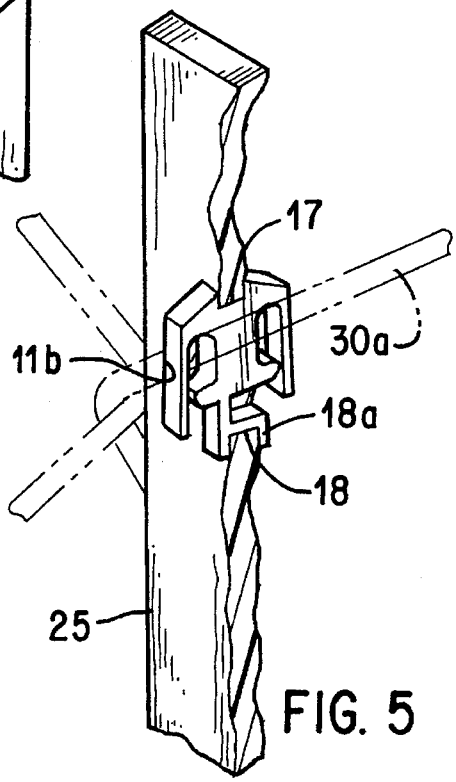
FIG. 5 is a front perspective view illustrating the preferred embodiment installed in a slat member and ready to be installed on fence link 30*a*.

Referring now to FIGS. 2,3 and 5, the installation of one of the devices of the invention in a slat 25 is shown. Slat 25 has an elongated slot 25*a* formed thereon which has a length and width such as to receive the device of the invention in a force fit. As can be seen in FIGS. 3 and 5, the device of the invention snugly fits within slot 25*a* with the upper end wall of the slot fitted in indented portion 17 and abutting against the bottom wall of this indented portion and with the lower end wall of the slot fitted into indented portion 18 and abutting against the upper wall thereof.

Figure 4:
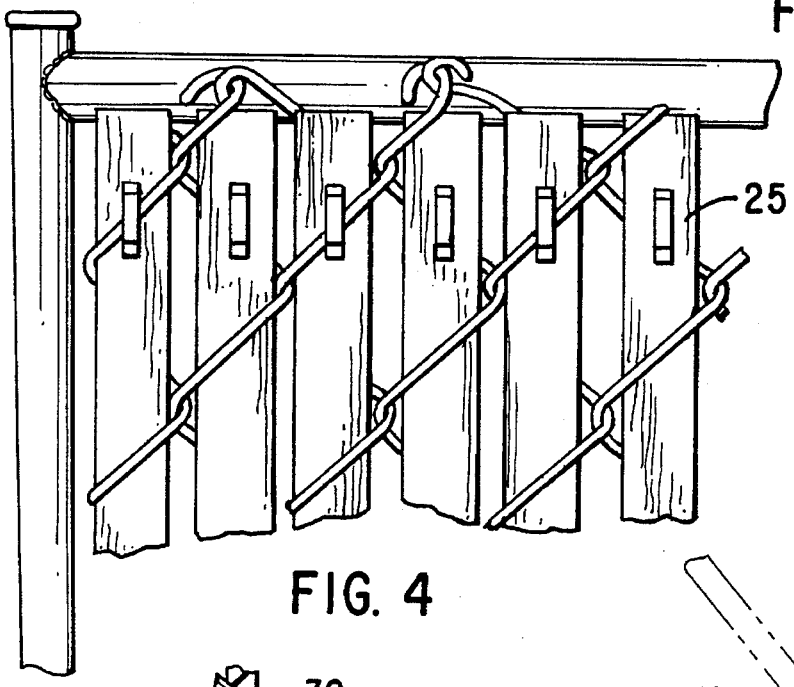
FIG. 4 is a front elevational view illustrating the use of the preferred embodiment in retaining slats to a chain link fence.

Referring now to FIGS. 3–5, the installation of a slat within a chain link fence by means of the device of the invention is illustrated. As shown in FIG. 5, the slat 25 is about to be installed on link 30*a* of fence 30. As shown in FIG. 3, the slat has been installed by pushing the hook member formed by finger 11*b* and protuberance 14*b* onto link 30*a*. The outer wall of protuberance 14*b* is curved outwardly from its bottom to its top so that link 30*a* can readily be forced past the protuberance into the slot with finger 11*b* being urged outwardly during such installation. The top wall of the protuberance extends laterally in a manner to prevent the exiting of the link from the slot 15*b* once it is installed therein.

FIG. 4 shows a plurality of slats installed within chain link fence 30. As can be seen, the retainer devices of the invention alternately attach to the links of the fence on one side of the slat and then the other. It thus can be seen that in view of the mirror image construction of the device of the invention with similar hook members provided on opposite sides of the slats, that the slats can be more easily installed within the fence.

It is to be noted that the device of the invention can be preinstalled in the slats at the factory or if so desired can be installed by the end user at the time of or prior to installation.

While the invention has been described and illustrated in detail, it is to be clearly understood that this is to be taken by way of illustration and example only, and is not to be taken by way of limitation,the scope of the invention being limited only by the terms of the following claims.

I claim:

1. In combination, a slat having an elongated slot formed therein, and a retainer for retaining said slat to one of links of a chain link fence, said retainer comprising:

a central portion having opposing broad substantially flat surfaces and opposite side walls extending substantially normally to said broad surfaces, a similar finger running opposite each of the side walls of said central portion, one end of each of said fingers being attached to said central portion, the other end of each of said fingers being free, a slot having a closed end and an opposite open end formed between each of said fingers and its opposing side wall, said fingers and side walls forming hook members which are mirror images of each other, means for partially blocking the open end of the slot formed between each of said fingers and its opposing side wall, and means on said central portion for securely mounting said retainer in the elongated slot of said slat, said slat being installed on a link of said fence by hooking either one or the other of said hook members onto said link with said link being pushed past said blocking means, said blocking means permitting the hook member to be readily installed on said link but resisting removal therefrom once installed.

2. The device of claim 1 wherein said blocking means comprises a protuberance extending from each of said side walls, said protuberance having an outwardly curving bottom end and a substantially lateral top end whereby the link can readily slide past the bottom end into the slot but is prevented from coming out of the slot.

3. The device of claim 1 wherein the means on said central portion for securely mounting said retainer in the slot of said slat comprises indentations on the top and bottom ends of said central portion, said indentations fitting snugly within the ends of said slot.

4. In a slat having an elongated slot formed therein, a retainer device for retaining said slat in a chain link fence comprising:

a central portion having opposing flat surfaces and a pair of opposing similar side walls extending between the opposite ends of said surfaces, a finger running opposite each of said side walls, said fingers being attached at end thereof to said central portion, the other ends of said fingers being free, an open ended slot being formed between each of said fingers and said side walls, a protuberance extending from each of said side walls into said slots near the open ends thereof thereby partially blocking the entrance to each of said slots, said fingers, side walls and protuberances forming hook members on the opposite sides of said central portion which are mirror images of each other, and indentations formed in the top and bottom of said central portion, said indentations fitting into the slot of the slat in tight engagement with the slat, each of the hook members formed by said fingers, side walls and protuberances being adapted to fit onto a link of said fence in firm retention thereon by forcing said link past said protuberance into the slot formed by said each of said hook members.

5. The device of claim 4 wherein said protuberances have rounded outer ends which permit easy passage of said link past said protuberances and substantially lateral inner ends which prevent said link from coming out of the slots formed by the hook members once installed therein.

* * * * *